United States Patent [19]

Beach et al.

[11] 4,165,943

[45] Aug. 28, 1979

[54] GRITLESS SEAL

[75] Inventors: John R. Beach, Elmhurst; L. Peter Sauer, Glenview; William J. Haraden, Libertyville, all of Ill.

[73] Assignee: Signode Corporation, Glenview, Ill.

[21] Appl. No.: 840,829

[22] Filed: Oct. 11, 1977

[51] Int. Cl.[2] ..... B25G 3/28; F16G 11/00

[52] U.S. Cl. ..... 403/285; 403/313; 403/393; 403/396; 339/276 R

[58] Field of Search ..... 403/284, 285, 2, 393, 403/396, 313, 309, 305; 339/276 R; 29/509, 517, 521; 285/80; 100/30

[56] References Cited

U.S. PATENT DOCUMENTS

| | | | |
|---|---|---|---|
| 1,283,062 | 10/1918 | Brooks | 403/393 X |
| 1,936,186 | 11/1933 | Brenizer | 403/284 X |
| 2,269,285 | 1/1942 | Ott | 403/393 X |
| 2,279,677 | 4/1942 | Heinrich | 403/2 X |
| 2,604,508 | 7/1952 | Bergan | 403/305 X |

FOREIGN PATENT DOCUMENTS

| | | | |
|---|---|---|---|
| 820,899 | 9/1959 | United Kingdom | 403/313 |

*Primary Examiner*—Wayne L. Shedd

*Attorney, Agent, or Firm*—Dressler, Goldsmith, Clement, Gordon & Shore, Ltd.

[57] ABSTRACT

A gritless seal, a method for making the seal, and a method for forming a joint with the seal between overlapped ligature segments is provided. The inner gripping layer is brittle and has a hardness greater than that of the outer, ductile layer. In forming the joint, the seal is disposed about the overlapped ligature segments and is folded, squeezed, and/or crimped about the segments under pressure sufficient to deform the outer, ductile layer and produce fracture cracks in the inner gripping layer which present sharp edges to engage and hold the surfaces of the overlapping ligature segments. The interior of the sheet steel seal is case hardened by known cyaniding techniques.

17 Claims, 13 Drawing Figures

20
40
44
2.
24
26
30
70
72
74
O
N
M
6.
5.
60
50
X
Y REF
α
A
B
C

GRITLESS SEAL

BACKGROUND OF THE INVENTION

This invention relates to improvements in joining ligatures, such as straps and wires, and is particularly concerned with a seal and a method for applying a seal to form a joint between overlapped portions of a ligature to form a secure joint therebetween and to prevent relative movement of the overlapped portions of the ligature.

Ligatures of the type with which the present invention is concerned are used in many diverse fields. Their most common use, however, is in the field of packaging and securing. In the usual packaging situation, the package or bundle is encircled with a ligature until the ligature forms a loop with a portion of the ligature overlapping upon itself. The leading end segment of the ligature is then gripped and the trailing portion of the ligature is tensioned or pulled to tightly engage the ligature loop about the package. After sufficient tension has been pulled, the loop is secured, as by connecting the overlapping portions of the ligature together.

Many forms of ligatures of the types under consideration are in common use. The most common forms are wire and strap made of plastic, aluminum, iron and steel. The present invention has general utility with respect to all of the aforementioned types of ligatures.

One widely used method of connecting the overlapping ligature segments together about a package is to apply a separate, relatively small clamp around the overlapping ligature segments. The clamp can have many forms but is most commonly a piece of sheet steel stock which has a generally flattened, C-shaped configuration and which is known in the industry as a seal or seal blank. The seal is placed around the overlapping ligature segments and compressed thereabout with an appropriate tool (either manual or automatic and either portable or stationary). Typically the compression includes the formation of one or more notches or crimps within the seal blank, which crimps comprise regions of relatively high contact pressure between the seal and the overlapping ligature segments.

Different types of ligatures and seals have been developed over the years. However, it has been found that the joint formed with many of the types of ligatures and seals is not entirely satisfactory. Specifically, the joint may not be initially tight enough or the joint may loosen with time and/or upon being subjected to external loading conditions such as vibrations or impact during handling.

Many of the types of ligatures in use today are specially treated or coated with paint, wax, grease, oil, or other materials to prevent corrosion, improve appearance, improve automatic feeding characteristics within automatic strapping machines, or for other reasons. Some straps may also be especially heat treated. In any case, such treated straps may have a lower coefficient of sliding friction than untreated strap and may slip more easily in a joint formed by a crimped or compressed seal.

Also, in many industrial packaging situations, oil or grease may be accidentally or purposely applied to the strap. In any case, application of a compressed seal about such strap segments to effect a friction joint therebetween may not be performed with sufficient force to establish a tight enough joint that will hold under the tension applied to the strap. Even if the seal at first securely grips the overlapping strap segments, the strap segments may start to slide within the seal over a period of time or when subjected to vibration or other shock loading conditions.

With plastic strap the strap surface may be relatively smooth and have a relatively low coefficient of sliding friction. In addition, plastic strap has a tendency to stretch and undergo a transverse reduction in the width dimension when subjected to substantial tensile forces over a period of time. Obviously, these characteristics can decrease the joint strength capability or integrity of a joint formed with a compressed seal at given compression force.

To overcome these problems of seal/ligature slippage, a number of seal modifications have been developed. The U.S. Pat. No. 3,089,233 to Meier discloses a seal blank which is coated on the inside with relatively hard, small grit particles. When overlapped end portions of a strap are secured together, the particles are embedded in the adjacent faces of the strap ends and hold the strap ends against relative longitudinal movement. Similarly, the U.S. Pat. No. 3,237,256 to Young discloses a seal for plastic strap with grit material secured to the inner, strap-contacting surfaces of the seal.

Though the above-discussed grit-type seals function satisfactorily to cut through layers of wax, oil, or paint on strapping and form a secure joint, the grit on the seals poses a problem since some of the particles of grit tend to become detached from the seal and are then carried, or fall, into the tool or machine used to compress the seal about the overlapped straps. Eventually, a build-up of grit within the tool or machine causes operational problems. Thus, it would be desirable to provide a gritless seal free of any sources of particulate matter which could enter a strapping machine or seal applying machine or tool and have deleterious effects.

Other types of seals have been developed for providing increased gripping capacity and which do not use grit. Examples of such seals are those employing specially configured gripping projections or protuberances on the inner surface of the seal such as the seals for plastic strap disclosed in the U.S. Pat. No. 3,197,831 to Martin et al. and the U.S. Pat. No. 3,636,592 to Beach.

Though gritless seals of the above-described type have been found to function satisfactorily, they are not without disadvantages. The protuberances on the inner surface of the seal must be especially formed within the seal. This, of course, involves metal working operations such as stamping.

Personnel safety hazards and shipping problems also arise from the use of such gritless seals. Since the seals are shipped with sharp projections formed therein, the user of the seal must be careful not to cut himself on the projections during any handling operations involving the seal, as when loading the seals into a seal applying machine or into an automatic strapping machine. Further, the projections increase the thickness of the seal and thus decrease the number of seals that can be nestably stacked together within a given size shipping container.

Consequently, it would be desirable to provide a seal which would not require the additional metal working steps of forming special gripping projections and which would not have sharp projections which could injure the user. Further, it would be desirable to provide a seal which could be used on all types of strap and which could be supplied to the user in the form of a seal blank having relatively flat surfaces which would allow closer nestable stacking to permit a greater number of such seals to be packed within a given size box.

SUMMARY OF THE INVENTION

In accordance with the present invention, a seal blank is provided for joining and securing a pair of overlapping ligature segments. In a preferred embodiment the seal is adapted for joining a pair of overlapping flat strap segments and comprises a body of steel sheet stock adapted to be wrapped around the strap segments. The body has a planar central portion and flanges on opposite sides thereof bent out of the plane of the central portion. The seal has a hardened layer extending from the inner surface of the seal to a predetermined depth in the seal body. The hardened layer is brittle and has a hardness greater than the hardness of the remaining thickness of the seal body, which remaining thickness forms a relatively ductile and deformable body core.

According to the method of making the seal blank of the present invention, a piece of steel sheet stock is electroplated with zinc to a minimum thickness of about 0.0002 inches. The blank is then treated in a cyanide bath having a composition, by weight, of between 70 to 75% sodium cyanide, of between 26 to 30 percent sodium chloride, and of between 1 to 2% carbon in the form of graphite. The cyanide bath is maintained at a temperature of about 1500° F. and the seal blank is treated in this bath at that temperature for about 15 minutes after which time the blank is removed and quenched in oil.

According to the preferred method of forming a joint with the seal according to the present invention, the seal blank is disposed about the overlapped strap segments and is then folded or squeezed about the overlapping strap segments and also compressed or crimped at the edges under pressure sufficient to produce fracture cracks in the inner hardened layer whereby sharp edges of the fracture cracks engage and hold the surfaces of the overlapping strap segments and whereby the inner hardened layer is maintained against the surfaces of the overlapping strap segments by the deformed, ductile body core.

This seal thus provides a high strength gripping capability without the use of preformed and sharp teeth-like projections and without the use of a gripping layer of grit material. Thus, the seal, in accordance with the present invention, does not require the additional manufacturing step, such as stamping, required to form gripping projections on the inner surface of the seal. Further, for a given body stock thickness, more seals can be nestably stacked together because of the absence of any raised projections on the inner surface. Also, the absence of sharp teeth-like projections on the inner surface eliminates the possibility of injury to personnel during handling of the seal blank prior to application of the seal blank to a pair of overlapping strap segments.

Numerous other advantages and features of the present invention will become readily apparent from the following detailed description of the invention and embodiments thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figures 1, 2, 3, 4, 5, 6, 7:
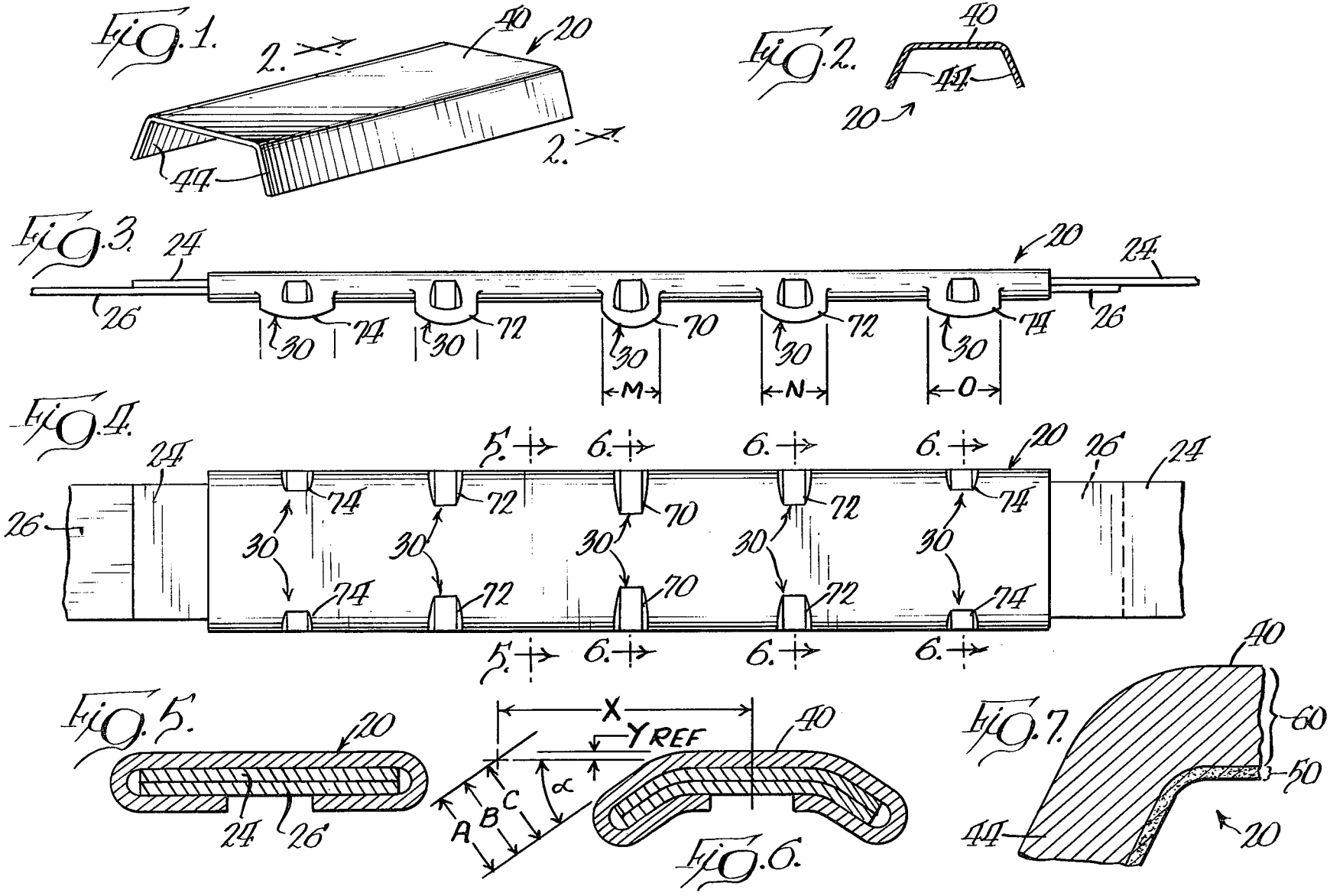
FIG. 1 is a perspective view of the seal blank of the present invention.
FIG. 2 is a cross-sectional view of the seal blank of the present invention taken generally along the plane 2—2 in FIG. 1.
FIG. 3 is a side elevational view of a seal blank of the present invention fully crimped about a pair of overlapping strap segments.
FIG. 4 is a top plan view of the seal blank of the present invention fully crimped about a pair of overlapping strap segments.
FIG. 5 is an enlarged cross-sectional view taken generally along the plane 5—5 in FIG. 4.
FIG. 6 is an enlarged cross-sectional view taken generally along any of the three planes 6—6 in FIG. 4.
FIG. 7 is an enlarged cross-sectional view of the corner of a seal blank of the present invention.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

The precise shapes and sizes of the components herein described are not essential to the invention unless otherwise indicated, since the invention is described with only references to embodiments which are simple and straightforward.

A seal blank in accordance with the present invention is illustrated in FIG. 1 and is designated generally as 20 therein. The illustrated seal blank 20 is intended to be used to join overlapping segments of flat plastic or metal strap in accordance with the preferred method of the present invention as illustrated in FIGS. 3 and 4 where the seal blank 20 is shown folded or wrapped around a pair of overlapping strap segments 24 and 26 and more positively engaged therewith by a series of deformations, such as pinched regions or crimps 30.

Though the seal blank 20 is illustrated as being adapted for joining overlapping flat strap segments, the seal blank of the present invention may also be adapted to join overlapping segments of other types of ligatures, such as wires, wire rope, or even various irregularly shaped ligature structures.

In the preferred embodiment, the seal blank 20 is formed from steel sheet stock in a generally flattened C shape and has a generally rectangular-shaped planar central portion 40 and generally rectangular-shaped legs or flanges 44 on opposite sides of, and each connected to, the planar central portion 40 by a longitudinally extending bend whereby the flanges 44 are bent out of the plane of the central portion 40.

FIG. 7 shows an enlarged section of the seal blank 20 taken at a corner wherein a flange 44 joins the central portion 40, such as the upper left hand portion of the cross-sectional view of the seal blank 20 shown in FIG. 2. As illustrated in FIG. 7, the seal blank body 20 has two layers. One is a layer of solid material which, for purposes of further discussion and as used in the claims, will be called the inner gripping wall or layer 50. When the seal 20 is folded or squeezed about overlapping strap segments 24 and 26 as illustrated in FIGS. 3 and 4, the inner gripping layer 50 lies in surface-to-surface contact with the ligature or strap segments. Adjacent to the inner gripping layer 50 is the body core or outer, ductile layer 60.

In accordance with the present invention, the inner gripping layer 50 is relatively brittle and has a hardness which is greater than the hardness of the outer ductile layer 60. The hardness of the inner gripping layer 50 is sufficient so that when the seal 20 is closed or folded about the overlappng ligature or strap segments 26 and 24 and pressed or compressed into firm engagement therewith to create deformations such as pinched regions or crimps 30 illustrated in FIGS. 3 and 4, fracture cracks form in the inner gripping layer 50, the sharp edges of which cracks penetrate and securely hold the surfaces of the overlapping strap segments. The sharp edges of the fracture cracks cut through the strap surface coatings such as wax, oil, paint, and the like. The outer ductile layer 60 is permanently deformed when the seal is pressed into engagement with the strap segments and serves to hold the inner gripping layer 50 (and edges of the fracture cracks therein) against the surfaces of the strap segments.

It is to be noted that the inner gripping layer 50 does not extend throughout the entire thickness of the seal blank 20 but rather, extends only to a predetermined depth within the seal blank body and that the remainder of the body, that is, the body core or outer ductile layer 60 extends from the inner gripping layer 50 to the outer surface of the seal blank. The inner gripping layer 50 has a hardness or brittleness such that it cracks easily when the seal blank 20 is compressed about the overlapping ligature segments. If the inner gripping layer 50 extended throughout the *entire* depth or thickness of the seal blank so that the seal blank consisted of just one brittle gripping layer, then, when the seal blank was compressed and crimped about overlapping ligature segments, the whole seal blank would crack and possible completely break in one or more places. Even if the seal blank would not break completely, there would be little likelihood that the seal blank would be held sufficiently tight against the overlapping ligature segments in the proper manner owing to the lack of a permanently deformable outer ductile layer, such as ductile layer 60.

In the preferred embodiment illustrated in FIGS. 1 through 7, the inner gripping layer 50 and the outer ductile layer 60 are shown as being integral with a single sheet of material. Though this is presently contemplated to be the simplest and most economical embodiment of the invention, it would be possible to fabricate a seal blank having a separate inner gripping layer formed from a separate brittle material and then encase the separate inner gripping layer with an outer, permanently deformable, ductile layer of the same or different material.

In the preferred embodiment of the seal blank of the present invention, the inner gripping layer 50 is preferably formed within the solid body of the seal blank by case hardening the inner side of the seal blank but not the other side. This may be done by encapsulating, coating, or electroplating the outer surface of the seal blank with a non-ferrous masking material and subjecting the seal blank to a carburizing liquid bath.

Preferably, with a seal blank made from 0.062 inch thick sheet stock of soft tempered, low carbon, cold-rolled steel No. 1017 or 1023, the exterior surface of the outer layer of the seal blank is electroplated with copper or zinc prior to subjecting the seal blank to the carburizing bath. Next, the seal blank is treated in a high temperature carburizing bath. Good results have been obtained with a bath having a composition, by weight, of 70 to 75% sodium cyanide, 26 to 30% sodium chloride, and 1 to 2% carbon in the form of graphite. The bath is maintained at a temperature of 1500° F. and the seal blank is held in the bath for about 15 minutes. The seal blank is quenched in oil immediately after removal from the carburizing bath.

Though the seal blanks are preferably quenched in oil upon removal from the carburizing bath, other media, such as water, air, etc., may be used.

It has been found that the seal blank can be adequately electroplated with zinc to a thickness of about 0.0002 inches and that a case-hardened layer of about 0.002 inches is produced on the inner surface of the seal when the bath parameters are maintained as described above. When zinc-coated or zinc-electroplated seal blanks are treated in the bath of the above-described composition, the coated surface takes on a very unusual green color, thus rendering a distinctive appearance to the seal blanks produced by this process.

Interestingly, the thickness of the case-hardened layer seems to be highly temperature dependent. It has been found that if the 0.062 inch thick seal blanks are treated in a bath of the above-described compositon at 1600° F. instead of 1500° F., the carbon from the bath is driven throughout the entire seal thickness and a clearly defined case-hardened layer is not produced. In use, such seals tend to crack and break throughout the entire thickness of the seal and are therefore not usable in a manner of the present invention. Even reduction of the time period during which the seal blank is subjected to the bath does not prevent the carbon from being driven throughout the entire seal at the higher temperatures, such as at 1600° F. Even when seal blanks are treated in the bath for 15 minutes at 1550° F., they tend to crack throughout their entire thickness when compressed about overlapping strap segments to form a joint. On the other hand, at 1500° F., the seal blanks can be treated for as long at 60 minutes and have much less of a tendency to crack completely through their thickness.

Other methods of forming the hardened, brittle, inner gripping layer 50 may also be used, such as nitriding, flame hardening, cladding, and flame spraying, including commercial processes such as those performed under the trade name Boraloy and Sursulf. It is to be realized, however, that the method of forming a brittle inner gripping layer should preferably produce an inner surface on the seal blank that is relatively gritfree and smooth to accommodate handling and feeding in power strapping machines until such time as the seal blanks are compressed and crimped about the overlapping ligature segments.

The seal blank of the present invention functions well and provides a relatively high strength grip capability with steel strapping that is painted, waxed, plastic-coated, electroplated, dipped, or covered with oil or grease. It has been found that the seal blank 20 of the present invention is suitable for use with a plastic strap such as nylon, polypropylene, polyester, and is especially suitable for steel strap material. The seal blank preferably is used with strap material having a width ranging from between 0.75 inches to 2.0 inches and having a thickness varying from between 0.025 inches to 0.062 inches.

In one preferred embodiment, the seal blank of the present invention is contemplated for use with steel strapping having a width of 1.25 inches and a thickness of 0.057 inches. For use with steel strapping, the seal blank of the present invention is preferably made from a sheet stock of a soft tempered, low carbon, cold-rolled steel No. 1017 or 1023. After being formed into the generally flanged or C-shaped configuration illustrated in FIGS. 1 and 2, the outer surface is coated with zinc or copper to a minimum thickness of about 0.0002 inches and the inner surface is case-hardened in a cyanide bath as described above. It has also been found that the seal can be case-hardened in cyanide as described above *before* it is formed into the flanged or generally C-shaped configuration illustrated in FIGS. 1 and 2. Surprisingly, with the preferred embodiment of seal having the dimensions and material composition described above, fracture cracks do not form in the bend line of the seal which is case-hardened as described above, contrary to what one might expect, when the flanges 44 are bent (about 60° or less from the plane of the central portion 40) to form the initial, unfolded, open, C-shaped seal blank.

The seal is preferably about 6.0 inches long and 0.062 inches thick. The hardened case thickness is preferably between 0.002 inches and 0.005 inches and is preferably about 0.002 inches thick, but not greater than 10% of the total thickness of the seal blank body. The case hardness must be of a value greater than the hardness of the remaining thickness of the seal blank body, i.e., the body core or outer ductile layer 60, and is preferably greater than Rockwell "C" 40. Preferably, the case hardness is Rockwell "C" 57. This compares with a preferred hardness of Rockwell "B" 92 for the outer ductile layer 60. With any greater body core or ductile layer hardness, there is a possibility that cracks formed in the inner gripping layer 50 will propagate into the outer ductile layer 60, or that separate cracks will form in the outer ductile layer 60, so as to break the seal body or otherwise degrade the integrity of the seal body.

The inner gripping layer 50 should be sufficiently harder than the strap material to allow the edges and protuberances of the fracture cracks to dig into the strap to a depth which, with metal strap, is preferably equivalent to about 5 points on the Rockwell "C" scale. With a case-hardened seal, the case hardness must be harder than the surface of the strapping to be joined. With plastic strap, the hardness of the inner gripping layer can be the lowest case hardness possible that will produce fracture cracks when a seal blank 20 is closed over the overlapping ligature segments and pressed into firm engagement therewith.

In order that a sufficient number of fracture cracks be produced in the inner gripping layer 50, it is necessary that the seal blank 20 be properly closed or folded about the overlapping ligature segments and sufficiently pressed into engagement therewith. It has been found that "notching," "pinching," or "crimping" the seal blank 20 about the overlapping ligature segments provides enough fracture cracks to form a good joint. It is to be realized that, after or during the closing or folding of the seal about the overlapping ligature segments, the fracture cracks can be formed by a continuing, or subsequently initiated, pressing or compression of portions of the seal to create deformations, or strains, as by local bending or stretching. In addition to the aforementioned "notching," "pinching," or "crimping," other forms of deformations may be used, including "wavy" deformations along the folded edge of the seal and including deformations interior of the folded seal edges.

In the preferred form of the method of the present invention, with reference to FIG. 3, a number of crimps 30 are provided along the opposed longitudinal edges of the seal 20. Preferably, there are provided a pair of center crimps 70, a pair of outer crimps 74 on each end of the seal blank 20, and a pair of intermediate crimps 72 on each side of the seal blank 20 between the center crimps 70 and the outer crimps 74. Each outer crimp 74 is preferably spaced inwardly about 0.6 inch from the end of the seal blank 20. The intermediate crimps and center crimps are then spaced at about 1.2 inch intervals along the seal blank body.

With reference to the preferred embodiment illustrated in FIG. 3, the center crimps 70 have a width M of 0.515 inch, the intermediate crimps 72 have a width N of 0.546 inch, and the outer crimps 74 have a width O of 0.640 inch. The depth of each crimp 30 is measured with respect to the intersection of reference coordinates X and Y illustrated in FIG. 6. The dimension X, measured outwardly from the longitudinal center line of the seal blank 20 is, for the purposes of this discussion, 1.359 inch. The dimension Y, the distance downwardly from the top surface of the planar portion 40 of the seal blank 20, is 0.072 inch. The depth of the crimp depression is illustrated in FIG. 6 with respect to the X and Y coordinates for the center, intermediate, and outer crimps and is designated therein by the dimensions A, B, and C respectively. For the center crimp 70, the dimension A is preferably 0.578 inch, for the intermediate crimp 72 the dimension B is preferably 0.547 inch, and for the outer crimp 74 the dimension C is preferably 0.453 inch. The angle of crimp deformation with respect to the planar portion 40 of the seal blank is designated by $\alpha$ in FIG. 6, and is preferably about 35°. Preferably, the crimping force applied to the crimps is 20,500 pounds for each center crimp 70, 17,250 pounds for each intermediate crimp 72, and 12,250 pounds for each outer crimp 74.

Though one particular crimp shape is illustrated for the preferred embodiment in FIGS. 3 and 4, it is to be realized that other deformations or crimp shapes may be used, including crimps that may be convex or concave. The crimps may be aligned generally in directions parallel to, or perpendicular to, the strap or ligature segments. Also, the crimp may be aligned at various angles with respect to the length of the ligature segments. It is to be understood that other combinations of (1) the number of crimps, (2) the crimp depression angle, (3) crimp depth, and (4) the crimp width may also produce satisfactory results and, in fact, may be required when different thicknesses of strap and seal blanks are used and when using seals having a different inner crimping layer hardness and/or different crimp shape.

A novel modification of the seal blank of the present invention is illustrated in six different embodiments in FIGS. 8 through 13. Specifically, the inner ligature-contacting surface of the seal blank is provided with a plurality of relatively small proturberances projecting from the surface. These projections provide a number of hard points which act to contact the ligature surface when the seal blank is squeezed about the overlapping ligature segments. The compression or squeezing of the seal blank about the ligature segments will create cracks in the brittle surface of the protuberances to provide more points and sharp edges which will serve to grip the ligature surfaces.

It has been found that proturberances in the form of a male or female knurl tooth pattern functions very well in producing a tight joint. Preferably, a male diamond knurl pattern in used with a 0.004 inch tooth height and with a 0.004 inch maximum tip flat. The teeth are arranged in the pattern at a 0.040 inch pitch at a 45° angle. Although this specific male diamond knurl tooth pattern has been found to work well, other forms of proturberances can also be used. These other forms may include a Swiss knurl, straight knurl, dimpled surface, patterned surface, punched surface or other types of projections raised from the surface of the seal blank.

Figure 8:
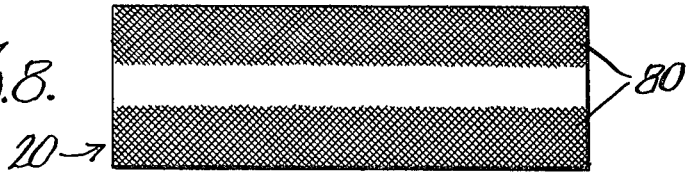
FIGS. 8–13 are bottom plan views of a seal blank of the present invention with each figure showing a different knurling pattern applied to the inner surface of the seal.
Figure 9:
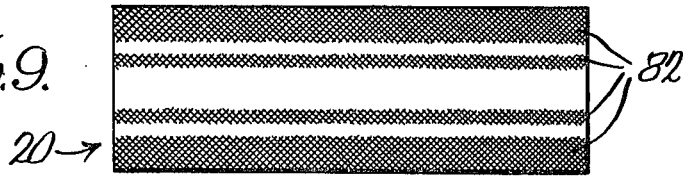
Figure 10:
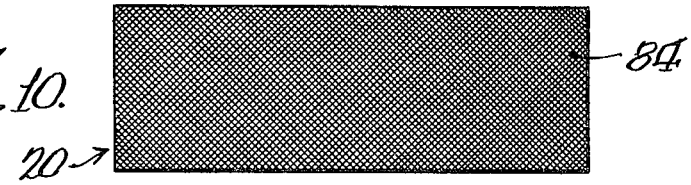
Figure 12:
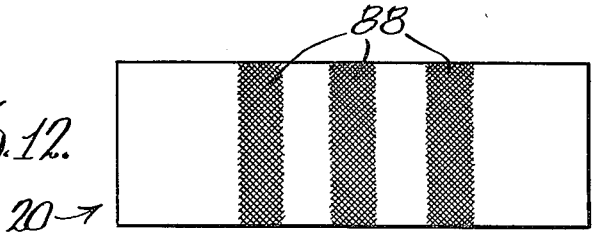
Figure 13:
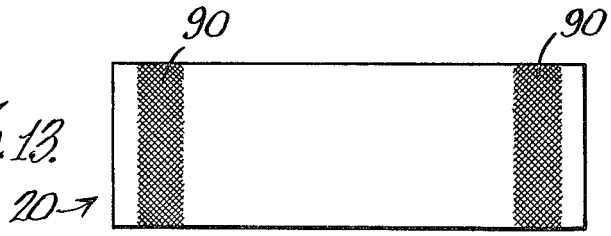

It has been found that with the preferred embodiment of the seal blank illustrated in FIGS. 3 and 4 wherein 5 pairs of crimps are employed along the longitudinal edges of the seal blank, the gripping capability of the seal blank 20 can be increased when a male diamond knurl tooth pattern is provided in the inner gripping layer 50 of the seal blank, at least in the area of one or more of the crimps. The overall coverage pattern of the inner gripping layer with the diamond knurl tooth configuration may have the following forms: two generally parallel strips 80 along the edges of the seal blank as illustrated in FIG. 8, four generally parallel longitudinal strips 82 as illustrated in FIG. 9, one band 84 completely covering the entire inner gripping layer as illustrated in FIG. 10, a plurality of spaced, square areas 86 located at each region where the blank is to be crimped as illustrated in FIG. 11, three generally parallel transverse strips 88 as illustrated in FIG. 12, and two generally parallel transverse strips 90 located at either end of the seal blank as illustrated in FIG. 13.

Obviously, the formation of the protuberances in the inner gripping layer 50, such as knurling the surface of the inner gripping layer with a male diamond knurl tooth pattern, is best done on the seal blank as a flat piece of sheet stock before it is formed into the generally flattened C-shaped configuration illustrated in FIG. 1, and certainly before it is treated to produce the hardened, brittle inner gripping layer 50 on the inner surface of the seal blank.

Figure 11:
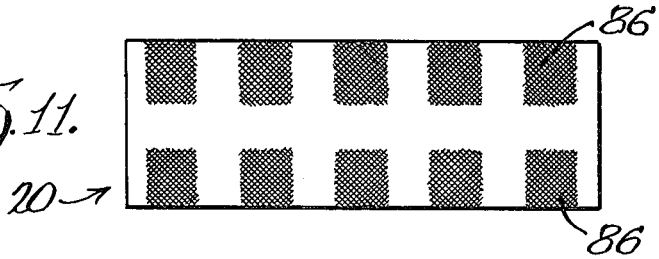

Tests were conducted on seal strapping joints with the preferred embodiment of the crimped seal described above having a male diamond knurl pattern (0.004 inch tooth height, 0.004 inch maximum tip flat, and 1/32 inch pitch on a 45° angle) arranged in an overall pattern as illustrated in FIG. 11. The tests have shown that the knurled seal provides a high strength joint which, when a sufficiently high tension force is applied to the strap segments, fails outside of the compressed seal blank 20 rather than inside the seal. In some tests the strap and the inside of a knurled seal blank were liberally coated with lubricating oil and in other tests the joint was maintained dry and free of oil. It was found that the failure occurred at about the same applied strapping tension for either the "dry" case or the "oil-coated" case. This was true for both a static application of a tension force and for a dynamic, or impact loading application of the tension force.

When knurling is used on the inner surface of the seal blank, the deformation structure, such as the array of crimps, can be reduced in magnitude or eliminated altogether so long as the folding of the seal about the overlapped ligature segments includes sufficient compression of portions of the seal to cause formation of the fracture cracks.

The present invention also contemplates the use of a "pre-cracked" seal blank in which the flanges of the seal (such as 44 in FIG. 1) or other portions of the seal blank are initially bent or deformed during fabrication to the extent required to produce a plurality of initial fracture cracks. This would be done before the seal blank was applied to overlapping ligature segments. When the blank was applied to the ligature segments, it would be firmly pressed and engaged therewith to produce, to some extent, a second plurality of fracture cracks. This procedure would allow the manufacturer to accurately control the "cracking" process and produce seal blanks having an initial, predetermined "gripping surface" structure.

From the foregoing, it will be observed that numerous variations and modifications may be effected without departing from the true spirit and scope of the novel concept of the invention. It is to be understood that no limitations with respect to the specific apparatus illustrated herein is intended or should be inferred. It is, of course, intended to cover by the appended claims all such modifications as fall within the scope of the claims.

We claim:

1. A seal for joining and securing a pair of overlapping strap segments wherein each strap segment has a generally rectangular cross section, said seal comprising:

a body having a generally rectangular-shaped central portion and a pair of generally rectangular-shaped legs each connected to said central portion by a longitudinally extending bend, said body formed of sheet steel material having a case-hardened brittle inner gripping wall integral therewith for lying in surface contact with said strap segments and an outer surface defining a ductile body core integral with said body between said outer surface and said inner gripping wall, said inner gripping wall having a hardness greater than said body core whereby, when the seal is closed about the overlapping strap segments and pressed into firm engagement therewith, fracture cracks form in said inner gripping wall to define a particle-free gripping wall having sharp crack edges which penetrate and securely hold the surfaces of the overlapping strap segments and whereby the inner gripping wall and fracture crack edges therein are held against the surfaces of the overlapping strap segments by said body core.

2. The seal in accordance with claim 1 wherein said inner gripping wall further defines initial fracture cracks formed therein by deformation of portions of said seal body prior to said seal being pressed into engagement with said segments.

3. The improvement in accordance with claim 1 in which the hardness of the inner gripping wall is greater than Rockwell "C" 40.

4. The improvement in accordance with claim 1 in which the thickness of the inner gripping wall is between 0.002 inches and 0.005 inches.

5. The improvement in accordance with claim 4 in which said body has a predetermined thickness and in which the thickness of the inner gripping wall is not greater than 10% of said predetermined thickness of said body.

6. The improvement in accordance with claim 1 in which the surface of said inner gripping wall has protuberances projecting therefrom.

7. The improvement in accordance with claim 6 in which said protuberances comprise a male diamond knurl tooth pattern.

8. The improvement in accordance with claim 7 in which the teeth have a height of 0.004 inches and a maximum tip flat of 0.004 inches.

9. The improvement in accordance with claim 7 in which the teeth are spaced at a 0.040 inches pitch in a 45° diamond array.

10. The improvement in accordance with claim 7 in which the teeth are provided in a plurality of discrete strips across the surface of the inner gripping wall.

11. In a compressed seal joining and securing a pair of overlapping strap segments wherein each strap segment has a generally rectangular cross section, said compressed seal having a seal body of steel sheet stock, said body having a generally rectangular-shaped central portion and a pair of generally rectangular-shaped legs each connected to said central portion by a longitudinally extending bend, the improvement comprising:

said body having a case-hardened brittle inner gripping wall integral therewith and an outer surface defining a ductile body core integral with said body between said outer surface and said inner gripping wall, said inner gripping wall cooperably compressing the strap segments together in direct surface contact, said inner gripping wall further having a hardness greater than said body core and having fracture cracks formed therein by the compression of the seal about the overlapping strap segments to define a particle-free gripping wall having sharp crack edges to grip the surfaces of the overlapping strap segments and which crack edges are held against the surfaces of the overlapping strap segments by the body core.

12. The improvement in accordance with claim 11 in which said seal has at least one crimp.

13. The improvement in accordance with claim 12 in which said seal has a plurality of crimps.

14. The improvement in accordance with claim 13 in which said crimps are disposed along at least one edge of said seal.

15. The method of forming a joint between overlapped segments of strap wherein each strap segment has a generally rectangular cross section, said method comprising:

providing a seal blank having a body of steel sheet material, said body having a generally rectangular-shaped central portion and a pair of generally rectangular-shaped legs each connected to said central portion by a longitudinally extending bend, said body having a case-hardened brittle inner gripping wall integral therewith and an outer surface defining a ductile body core integral with said body between said outer surface and said inner gripping wall, said inner gripping wall having a hardness greater than that of said body core;

disposing said seal blank about the overlapped strap segments arranged in face-to-face contact; and p1 squeezing the seal blank laterally of said overlapping strap segments under pressure sufficient to produce only fracture cracks in said inner gripping wall to define a particle-free gripping wall having sharp crack edges which engage and hold the surfaces of the overlapping strap segments and whereby said inner gripping wall is maintained against the surfaces of said overlapping strap segments by said body core.

16. The method in accordance with claim 15 in which the step of providing a seal having a body of sheet material includes providing a body having a central portion and a pair of flanges thereon joined to the central portion and in which the step of disposing said seal about the overlapped strap segments includes locating said flanges of the seal adjacent to the marginal edges of the overlapped strap ends.

17. The method in accordance with claim 16 in which said step of squeezing the seal blank includes the step of pinching at least one crimp in said seal about said strap.

* * * * *